US012410376B2

(12) United States Patent
Belowich et al.

(10) Patent No.: US 12,410,376 B2
(45) **Date of Patent: *Sep. 9, 2025**

(54) WATER BASED SEMI-SYNTHETIC METAL WORKING FLUID COMPOSITION CONTAINING AN ALKYL ALCOHOL AMINE

(71) Applicant: Dow Global Technologies LLC, Midland, MI (US)

(72) Inventors: Matthew E. Belowich, Phoenixville, PA (US); Qi Jiang, Shanghai (CN); Chao Zhao, Shanghai (CN); Xue Chen, Manvel, TX (US); Yong Zhao, Shanghai (CN)

(73) Assignee: Dow Global Technologies LLC, Midland, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/723,636

(22) PCT Filed: Mar. 31, 2022

(86) PCT No.: PCT/CN2022/084427
§ 371 (c)(1),
(2) Date: Jun. 24, 2024

(87) PCT Pub. No.: WO2023/184347
PCT Pub. Date: Oct. 5, 2023

(65) Prior Publication Data

US 2025/0051676 A1 Feb. 13, 2025

(51) Int. Cl.

| | |
|---|---|
| ***C10M 133/08*** | (2006.01) |
| ***C10M 109/00*** | (2006.01) |
| ***C10M 159/00*** | (2006.01) |
| *C10N 30/12* | (2006.01) |
| *C10N 30/16* | (2006.01) |

(52) U.S. Cl.
CPC ..... *C10M 133/08* (2013.01); *C10M 109/00* (2013.01); *C10M 159/00* (2013.01); *C10M 2203/1065* (2013.01); *C10M 2205/16* (2013.01); *C10M 2207/2805* (2013.01); *C10M 2215/042* (2013.01); *C10N 2030/12* (2013.01); *C10N 2030/16* (2013.01)

(58) Field of Classification Search
CPC ..... C10N 2010/02; C10N 2030/12; C10N 2030/16; C10N 2030/24; C10N 2030/52; C10N 2040/20; C10N 2050/01; C10M 173/00; C10M 2219/044; C10M 2203/1006; C10M 2203/1065; C10M 2207/046; C10M 2207/10; C10M 2207/124; C10M 2207/125; C10M 2207/126; C10M 2207/127; C10M 2207/2805; C10M 2215/02; C10M 2215/042; C10M 2215/044
See application file for complete search history.

(56) References Cited

U.S. PATENT DOCUMENTS

| | | | | |
|---|---|---|---|---|
| 3,723,314 | A * | 3/1973 | Davis | C10M 173/00 508/408 |
| 11,499,118 | B2 | 11/2022 | Hardt | |
| 2009/0170736 | A1* | 7/2009 | Brutto | C10M 173/02 554/108 |
| 2010/0093736 | A1* | 4/2010 | Coburn | A01N 43/80 507/131 |
| 2015/0376536 | A1* | 12/2015 | Kawasaki | C10M 133/08 508/511 |

FOREIGN PATENT DOCUMENTS

| | | |
|---|---|---|
| EP | 2083064 | 7/2009 |
| EP | 3135109 | 3/2017 |
| JP | 2009161585 | 7/2009 |
| WO | 2007130836 | 11/2007 |
| WO | 2008088632 | 7/2008 |
| WO | 2014085609 | 6/2014 |

OTHER PUBLICATIONS

Bennett, "Corrosion Inhibitors as Preservatives for Metalworking Fluids-Ethanolamines", Lubrication Engineering, 1979, vol. 35, No. 3, pp. 137-144.

* cited by examiner

*Primary Examiner* — Vishal V Vasisth

(57) ABSTRACT

The current invention relates to a novel class of alkyl alcohol amines where the amine is a primary amine. Embodiments relate to a method of controlling microbial growth in metal working fluids, comprising adding such an alkyl alcohol amine to the metal working fluid. Other embodiments relate to semi-synthetic metal working fluid compositions which include the microbial growth control agent comprising this particular class of alkyl alcohol amines.

12 Claims, No Drawings

WATER BASED SEMI-SYNTHETIC METAL WORKING FLUID COMPOSITION CONTAINING AN ALKYL ALCOHOL AMINE

This application is a 371 of PCT/CN22/84427, filed Mar. 31, 2022.

The current invention relates to a novel class of alkyl alcohol amines where the amine is a primary amine. Embodiments relate to a method of controlling microbial growth in metal working fluids, comprising adding such an alkyl alcohol amine to the metal working fluid. Other embodiments relate to semi-synthetic metal working fluid compositions which include the microbial growth control agent comprising this particular class of alkyl alcohol amines.

INTRODUCTION

Metal working fluids (EMWFs are used for lubrication of metal cutting and tool forming. These fluids provide cooling for the metal work tooling, removal of cutting chips from the tool/work piece interface and help provide an acceptable post-machining finished surface. Amines are a popular MWF component widely used in a variety of applications due to their properties of anti-corrosion, neutralization, and pH adjustment. Organic amines are usually used as corrosion inhibitors because MWFs are degraded over time due to microbial growth which negatively impacts fluid performance and the microbes feed on the active ingredients in the fluid.

Such microbial growth in the MWFs may cause serious problems in metalworking processing in many forms including: MWFs general souring, MWFs viscosity changing, MWFs shelf life shortening, and the corroding of tools and materials. Additionally, the functioning of equipment and processes such as feeding nozzles, storage tanks, pipelines and recycling system facilities may also be impacted by microbe growth in MWFs. This souring increases the cost of MWFs, accelerates corrosion rates and decreases efficiency of metal processing. Thus, there is an unfulfilled need in the MWF industry for components which do not support microbial growth and maintain performance over a long time.

Thus, there is an unfulfilled need in the MWF industry for components which do not support microbial growth and maintain performance over a long time. The most common solution is to add biocides and amine alcohols either continuously or as a batch treatment to a given MWF. However, biocides and some secondary amine alcohols are limited by regulatory restrictions and most of the biocide chemicals will release formaldehyde over time which is hazardous to human health.

Existing MWFs are typically classified as neat oil, soluble oil, semi-synthetic fluid, or synthetic fluid, with each category exhibiting different functions of cooling, lubricating, anti-rust and cleaning. Soluble oil MWFs comprise 50-70 wt. % neat oil with the remainder of the MWF being anti-wear/extreme pressure additives and emulsifiers. Neat oils and soluble oils typically do not provide the same level of cooling compared with water-based metalworking fluids. Synthetic fluids typically cannot provide the good lubricity performance because their lubricity function is affected by polyalkylene glycol reverse dissolution when the temperature is higher than cloud point. Semi-synthetic materials offer the possibility of simultaneously providing good lubricity and cooling for use in demanding applications. A typical semi-synthetic fluid consists of oils, organic acid, emulsifiers, lubricants, amines, water and other ingredients.

The amount of water in such semi-synthetic MWFs is typically up to 50-60 wt. %, with around 10-40 wt. % base oil, around 10-20 wt,% emulsifiers, around 10-20 wt. % amine, and other functional additives such as acid, lubricant, solubilizer, biocide etc. Semi-synthetic MWFs are usually diluted with additional water at an end user's site to a base oil concentration of 1-20 wt. %, more typically 5-7 wt. % concentration by weight of the diluted formulation.

In semi-synthetic fluids, emulsifiers are often added to form stable dispersion of oil in water. Emulsifier particles are located around the oil droplets to give them a negative charge that will bind them to the water molecules. The size of such emulsified oil drops is very important to fluid performance, as it is generally easier for the smaller emulsion sizes to penetrate the interface of the cutting zone. The emulsifiers also contribute to the stability of semi-synthetic fluids.

Semi-synthetic fluids will degrade over time in part due to microbial growth which negatively impacts fluid performance because microbes feed on the active ingredients in the fluid. Such microbial growth in the MWFs may cause serious problems in metal working processing in many forms including: MWFs general souring, MWFs viscosity changing, MWFs shelf life shortening, and the corroding of tools and materials. Additionally, the functioning of equipment and processes such as feeding nozzles, storage tanks, pipelines and recycling system facilities may also be impacted by microbe growth in MWFs. This souring increases the cost of MWFs, accelerates corrosion rates and decreases efficiency of metal processing. The most common solution to control microbial growth is to add biocides and amine alcohols either continuously or as a batch treatment to a given MWF. However, biocides and some secondary amine alcohols are limited by regulatory restrictions and most of the biocide chemicals will release formaldehyde over time which is hazardous to human health.

It is therefore desired to have new semi-synthetic metal working formulations with new biocidal compositions which provide improved cooling, lubricity, concentrate stability, and long shelf life, without the environmental health and safety concerns of present fluids.

This invention addresses at least some of the above-described needs.

SUMMARY

The present invention relates to a novel class of alkyl alcohol amines where the amine is a primary amine. The present invention also relates to a method of controlling microbial growth in metal working fluids, wherein the method includes the addition of at least one such alkyl alcohol amine to the metal working fluid. The present invention also describes a water based semi-synthetic metal working fluid comprising a base oil, an organic acid, emulsifiers, a concentrate additive, water and a microbial growth control agent which comprises the novel alkyl alcohol amine.

DETAILED DESCRIPTION

Depending on their composition, metal working fluids are classified as neat oil, soluble oil, semi-synthetic fluid, or synthetic fluid. Soluble oil MWFs comprise 50-70 wt. % oil with the rest being anti-wear/extreme pressure additives and emulsifiers. Semi-synthetic MWFs contain a significant amount of water, typically up to 50-60 wt. %. Semi-synthetic fluids have balanced lubricity and cooling performance and are thus attractive for use as MWFs.

The present invention relates to semi-synthetic metal working fluids, and new materials which can be used as antimicrobials for use in such fluids. The materials of the present invention are alky alcohol amines corresponding to the following formula (I):

formula (I)

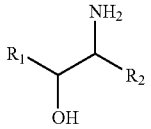

where $R_1$ and $R_2$ are H, or a C2 to C8 alkyl group, with the proviso that at least one of $R_1$ and $R_2$ is H and at least one of $R_1$ and $R_2$ is a C2 to C8 alkyl group. The C2 to C8 alkyl groups may be linear, branched, or cyclic, but linear is generally preferred.

Such alkyl amine alcohol materials can be produced by alkoxylation reaction of ammonia with oxides (such as ethylene oxide, propylene oxide, butylene oxide), as is generally known in the art.

The MWFs of the present invention comprise water, one or more base oils, one or more organic acids, one or more emulsifiers, one or more lubricants, one or more amines, where amines function as pH adjusters and/or microbial growth control agents, where the at least one amine comprises at least an alkyl amine alcohol of formula (I).

The microbial growth control agent may further comprise one or more additional antimicrobial materials such as glycol ether amines which may be used in combination with the above disclosed materials to achieve a certain microbial growth control targets. The concentration of the microbial growth control agent/pH adjuster in the MWF (including the alkyl amine alcohols of formula (I) may range front 1, 4, 6, 8, or 10 percent by weight of the formulation up to 30, 25, 15, or 12 percent of the formulation. Preferably the alky amine alcohol(s) of formula (I) comprise from 2, preferably 3, or even 5 percent up to 25, preferably 20 or even 15 percent by weight of the MWF.

The semi-synthetic MWFs of the present invention also include a base oil. The base oil can be any base oil generally known in the art for use in MWFs. Preferably the base oil is a base oil selected from tall oils, naphthenic oils, paraffinic oils or ester oils, or combinations thereof. The concentration of the base oil(s) in the MWF may range from 5, 7, 10, or 15 percent by weight of the formulation up to 50, 45, 40, or 35 percent of the formulation.

The water used in the present formulations is preferably deionized water, and may comprise from at least 20, preferably 25, 30, or even 35 percent by weight of the formulation up to a maximum of 70, 65, 60, 55 or even 50 percent by weight of the formulation, it is contemplated that these formulations may be further diluted with additional water prior to use, altering these ranges accordingly. For example, prior to use, the formulations may be diluted such that the base oil concentration is from 1 to 20 percent by weight of the diluted formulation, more typically 5 to 7 percent by weight.

The semi-synthetic MWFs of the present invention also include one or more organic acids as solubilizers and/or corrosion inhibitors. Preferred organic acids include 2-ethylhexoic acid, azelaic acid, toll oil fatty acid, 12-hydoxyl-(cis)-9-octadecenoic acid, dicarboxylic acid, and 9-octadecenoic acid. The concentration of the organic acid in the MWF may range from 2, 3, 4, or 5 percent by weight of the formulation up to 12, 10, 8, or 7 percent of the formulation.

The semi-synthetic MWFs of the present invention also include one or more emulsifiers. The emulsifier may be anionic, cationic or nonionic. Examples of suitable anionic surfactants or emulsifiers are alkali metal, ammonium and amine soaps; the fatty acid part of such soaps contains preferably at least 10 carbon atoms. The soaps can also be formed "in situ;" in other words, a fatty acid can be added to the oil phase and an alkaline material to the aqueous phase.

Other examples of suitable anionic surfactants or emulsifiers are alkali metal salts of alkyl-aryl sulfonic acids, sodium dialkyl sulfosuccinate, sulfated or sulfonated oils, e.g., sulfated castor oil; sulfonated tallow, and alkali salts of short chain petroleum sulfonic acids.

Suitable cationic surfactants or emulsifiers are salts of long chain primary, secondary or tertiary amines, such as oleylamide acetate, acetylamine acetate, di-dodecylamine lactate, the acetate of aminoethyl-aminoethyl stearamide, dilauroyl triethylene tetramine diacetate, 1-aminoethyl-2-heptadecenyl imidazoline acetate; and quaternary salts, such as cetylpyridinium bromide, hexadecyl ethyl morpholinium chloride, and diethyl di-dodecyl ammonium chloride.

Examples of suitable nonionic surfactants or emulsifiers are condensation products of higher fatty alcohols with ethylene oxide, such as the reaction product of oleyl alcohol with 10 ethylene oxide units; condensation products of alkylphenols with ethylene oxide, such as the reaction product of isoctylphenol with 12 ethylene oxide units; condensation products of higher fatty acid amides with 5, or more, ethylene oxide units; polyethylene glycol esters of long chain fatty acids, such as tetraethylene glycol monopalmitate, hexaethyleneglycol monolaurate, nonaethyleneglycol monostearate, nonaethyleneglycol dioleate, tridecaethyleneglycol monoarachidate, tricosaethyleneglycol monobehenate, tricosaethyleneglycol dibehenate, polyhydric alcohol partial higher fatty acid esters such as sorbitan tristearate, ethylene oxide condensation products of polyhydric alcohol partial higher fatty acid esters, and their inner anhydrides (mannitol-anhydride, called Mannitan, and sorbitol-anhydride, called Sorbitan), such as glycerol monopalmitate reacted with 10 molecules of ethylene oxide, pentaerythritol monoleate reacted with 12 molecules of ethylene oxide, sorbitan monostearate reacted with 10-15 molecules of ethylene oxide, mannitan monopalmitate reacted with 10-15 molecules of ethylene oxide; long chain polyglycols in which one hydroxyl group is esterified with a higher fatty acid and other hydroxyl group is etherified with a low molecular alcohol, such as methoxypolyethylene glycol 550 monostearate (550 meaning the average molecular weight of the polyglycol ether). A combination of two or more of these surfactants may be used; e.g., a cationic may be blended with a nonionic or an anionic with a nonionic.

Particularly suitable emulsifiers include C16-18 alcohols which have been ethoxylated or propoxylated; ethoxylated C12-C15 alcohols; sodium alkane sulfonate and alky ether carboxylates.

The concentration of the emulsifier(s) in the MWF may range from 4, 5, 6, 8, or 10 percent by weight of the formulation up to 25, 20, 15, or 12 percent of the formulation.

The semi-synthetic MWFs of the present invention may also include one or more concentrate additives. If present, preferred concentrate additives include diethylene glycol butyl ether, ethylene glycol monobutyl ether, and propylene glycol butyl ether. If present, the concentration of the concentrate additive(s) in the MWF may range from 0.3, 0.5, 1.0, or 1.5 percent by weight of the formulation up to 2.5, 2.0, or 1.8 percent of the formulation.

The semi-synthetic MWFs of the present invention may also include other additives to provide additional functionality as generally known in the art.

The microbial growth controlled by the presently disclosed biocide typically consists of contaminations which are a bacterial and fungal mixture. Some typical fungi and bacterial 5 containments include but are not limited to *Aeromonas hydrophila* (ATCC 13444), *Candida albicans* (ATCC 752), *Desulfovibrio desulfuricans* (ATCC 7757), *Escherichia coli* (ATCC 8739), *Flavobacterium ferrugineum* (ATCC 13524), *Fusarium oxysporum* (ATCC 7601), *Klebsiella pneumoniae* (ATCC 13883), *Proteus mirabilis* (ATCC 4675), *Pseudomonas aeruginosa* (ATCC 8689), *Pseudomonas oleovorans* (ATCC 8062) and *Saccharomyces cerevisiae* 10 (ATTC 2338). The strains listed above can vary around the world and the present innovation is fully envisioned as broad-spectrum microbial growth control agent and/or biocide which can be used against any common MWF microbial contaminates.

EXAMPLES

Experiments to test the efficacy of formulations including the presently disclosed microbial growth control agent can be conducted as follows. Table 1 contains a description of the materials used in these examples.

TABLE 1

Diluted Metalworking Fluid Ingredients

| Material | Type | Source |
|---|---|---|
| Mineral oil | Oily agent | SCRC |
| EcoSurf SA-7 | Emulsifer | Dow |
| Dowfax 20A42 | Emulsifer | Dow |
| Secondary alkane sulphonate | Anionic surfactant | SCRC |
| Tall oil acid | Corrosion agent | SCRC |
| Sebacic acid | Corrosion agent | SCRC |
| Monoisobutanolamine | pH adjustor | Dow |
| 2-Amino-1-butanol/ Monoisobutanolamine mixture | pH adjustor | Dow |
| Monoethanolamine | pH adjustor | Dow |
| Monoisopropanolamine | pH adjustor | Dow |
| AMP-95 (2-amino-2-methyl-1-propanol) | pH adjustor | Angus Chem |
| Processing Water | Water containing common bacterial agents found in metal working processes | N/A |
| Tap Water | Water containing 50 ppm metal | N/A |
| Aluminum strip (#ADC12) | Metal | TCI |
| 1,2-epoxybutane (CAS: 106-88-7) | Starting material for synthesis | Sigma-Aldrich |
| 28% Aqueous ammonium hydroxide (CAS: 1336-21-6) | Solvent & starting material for synthesis | Sigma-Aldrich |

A series of formulations is prepared according to Table 2, with the different amines listed in Table 3.

TABLE 2

| Material | Concentrated Formulation |
|---|---|
| Mineral oil | 12.5 wt. % |
| EcoSurf SA-7 | 7.5 wt. % |

TABLE 2-continued

| Material | Concentrated Formulation |
|---|---|
| Dowfax 20A42 | 5.5 wt. % |
| Secondary alkane sulphonate | 4.5 wt. % |
| Tall oil acid | 4.5 wt. % |
| Sebacic acid | 4.5 wt. % |
| Amine (as indicated in Table 3) | 10.7 wt. % |
| Water | 50.3 wt. % |

TABLE 3

| Item | Amine type | Diluted water type |
|---|---|---|
| Example 1 (IE1) | Monoisobutyanolamine | Processing water |
| Example 2 (IE2) | 2-Amino-1-butanol/ Monoisobutanolamine mixture at 30:70 ratio | Processing water |
| Example 3 (IE3) | Monoisobutyanolamine | Tap water |
| Example 4 (IE4) | 2-Amino-1-butanol/ Monoisobutanolamine mixture at 30:70 ratio | Tap water |
| Comparative Example 1 (CE1) | Monoisopropanolamine | Processing water |
| Comparative Example 2 (CE2) | AMP-95 | Processing water |
| Comparative Example 3 (CE3) | Dicyclohexylamine | Processing water |
| Comparative Example 4 (CE4) | Monoisopropanolamine | Tap water |
| Comparative Example 5 (CE5) | AMP-95 | Tap water |
| Comparative Example 6 (CE6) | Dicyclohexylamine | Tap water |

Examples and comparative examples are water diluted Concentrated Formulation by 20 times.

The concentrated formulations are prepared as follows. The indicated amount of deionised water is poured into a container. Add mineral oil, Ecosurf SA-7 Dowfax 20A42, secondary alkane sulfonate, tall oil acid and diacid (sebacic acid) into the water. Stir the formulation by magnetic stirrer at 200 rpm at 60° C. for 1 hour. Add the indicated amine as pH adjustor.

The concentrated formulations are then diluted by processing water or tap water (as indicated in Table, 3) by a factor of 20 times, based on the quantity of the whole concentrated formulation. Test pH value by pH titrator (Mettler Toledo: #SevenMulti). If pH value of the diluted formulation is below 9.5, introduce additional monoethanolamine (1-2 droplets) to increase pH value to at least 9.5.

pH aging test: test pH value by pH titrator (Mettler Toledo: #SevenMulti) of prepared diluted formulations for 0-day and 14-day. Samples are placed in ambient temperature.

TABLE 4

| pH aging test: | | | | |
|---|---|---|---|---|
| Sample # | Initial pH value | 1-week aging pH value | 2-week aging pH value | pH loss (%) |
| IE1 | 9.67 | 9.43 | 9.43 | −2.5% |
| IE2 | 9.52 | 9.31 | 9.31 | −2.2% |
| CE1 | 9.55 | 8.72 | 8.52 | −10.8% |
| CE2 | 9.54 | 9.29 | 9.29 | −2.6% |
| CE3 | 9.63 | 9.33 | 9.30 | −3.4% |

The pH decrement after 2-week aging should be as small as possible, IE1 with monoisobutylamine, IE3 with 2-amino-1-butanol/monoisobutanolamine mixture and CE2 & 3 with AMP-95 and dicyclohexylamine demonstrate similar level in which pH loss is controlled within 5%. CE1 with monoisopropanolamine is not good in that pH loss exceeds 10%.

Aluminum corrosion test: Clean the Al strips (#ADC12) with alcohol and weigh strips. Immerse the Al strips into the test solution at 40° C. for 48 hours with capped vials (a half volume of Al strip in solution and a half volume of Al strip exposed to air). Observe the corrosion of Al strip surface, measure weight loss of Al strips and use ICP-OES: inductively coupled plasma-optical emission spectrometer (Perkin Elmer: #Optima 5300DV) to detect Al content in formulations.

TABLE 5

| Aluminum corrosion test: | | |
|---|---|---|
| Sample # | Corrosion | Aluminum content by ICP-OES |
| IE2 | pass | 0.53 ppm |
| IE4 | pass | 0.39 ppm |
| CE4 | pass | 0.11 ppm |
| CE5 | marginal | 0.42 ppm |
| CE6 | fail | 2.60 ppm |

The ICP-OES data shows alignment with qualitative observation of aluminum strip corrosion. Larger area with yellow color demonstrates serious corrosion and higher aluminum content in test fluid. The qualitative description "pass", "marginal" or "fail" are added to comparatively describe the results observed. IE2 with monoisobutylamine, IE4 with 2-amino-1-butanol/monoisobutanolamine mixture and CE4 with isomonopropanoiamine and CE5 with AMP-95 is good at corrosion resistance with less than 1 ppm aluminum leaching from strip. CE6 is worse than any other sample that more than 2 ppm aluminum content has been leaching into fluid.

Antimicrobial test: Samples are operated under ASTM E 2275 method. This method can be summarized as follows:

The inoculum is a mixture of ATCC strains of bacteria and fungi as set forth in Table 6. The Emulsion Products Mixed Inoculum is prepared by adding 0.1 mL of each bacterial overnight broth culture and 1.0 mL of each yeast broth culture to the 10 mL of mold suspension and blending.

50 grams of sample are dosed with 0.5 ml of the mixed inoculum. This inoculation will challenge emulsion samples with a high level (106-107 Colony Forming Units per gram of sample. CFU/g) of microorganisms, Challenged samples are mixed and stored in the incubator at 30° C. for seven days. This process is repeated for 5 additional rounds of testing with the following amounts of inoculum being added to each sample: 2nd round 0.5 mL; 3rd round 1.0 mL; 4th round 1.0 mL; 5th round 3.0 mL.

The inoculated emulsion samples are monitored for microbial growth by agar plating using a standard streak plate method. Samples are plated on one and seven days after each microbial challenge. Samples are blended by shaking, vortexing, or stirring with a sterile stick or rod. Samples are uniformly streaked onto TSA and PDA plates preferably using standard 10 μL inoculating loops. The streaked agar plates are incubated at 30° C. (TSA) and 25° C. (PDA) for seven days.

All of the agar plates are checked seven days after plating to determine the number of microorganisms surviving in the test samples. For the plates streaked 7 days post inoculation, no colony growth will be considered a PASS.

TABLE 6

| Microorganisms | ATCC # |
|---|---|
| Bacteria: | |
| *Pseudomonas aeruginosa* | 10145 |
| *Pseudomonas putida* | 12633 |
| *Enterobacter aerogenes* | 13048 |
| *Alcaligenes faecalis* | 25094 |
| *Proteus hauseri* | 13315 |
| *Burkholderia cepacia* | 21809 |
| *Gluconacetobacter liquefaciens(Asai)* | 14835 |
| *Gluconacetobacter liquefaciens* | 23751 |
| Yeast: | |
| *Saccharomyces cerivisae* | 2338 |
| *Candida lipolytica* | 18942 |
| Mold: | |
| *Aspergillus niger* | 6275 |
| *Penicillium ludwigii* | 9112 |

TABLE 7

| Antimicrobial test: | | | | | | | | | | |
|---|---|---|---|---|---|---|---|---|---|---|
| Sample # | Day-1, Week-1 | Day-7, Week-1 | Day-1, Week-2 | Day-7, Week-2 | Day-1, Week-3 | Day-7, Week-3 | Day-1, Week-4 | Day-7, Week-4 | Day-1, Week-5 | Day-7, Week-5 |
| IE2 | Pass | Pass | Pass | Pass | Pass | Pass | Pass | Pass | Pass | Pass |
| IE4 | Marg | Pass | Marg | Pass | Marg | Pass | Marg | Pass | Marg | Pass |
| CE4 | Fail | Fail | Fail | Fail | Fail | Fail | Fail | Fail | Fail | Fail |
| CE5 | Fail | Pass | Fail | Pass | Fail | Pass | Fail | Pass | Fail | Pass |
| CE6 | Pass | Pass | Pass | Pass | Pass | Pass | Pass | Pass | Pass | Pass |

Pass = no colony growth
Marg = Marginal = marginal colony growth
Fail = significant colony growth CE4 with isomonopropanolamine fails in all rounds of the testing. CE5 with AMP-95 can pass the test by the end of week but fails upon first contact with microbe in first day of every round test. IE2 with monoisobutylamine, and CE6 with dicyclohexylamine show good antimicrobial performance that can pass every round trial no matter about day-1 or day-7. IE4 with 2-aamino-1-butanol/monoisobutanolamine mixture can also pass 5 round test and show good performance on day-7, but exhibits slightly worse performance on day-1 versus IE2 and CE6.

A good amine pH adjustor should pass all of three test items. Thus, monoisobutylamine, 2-amino-1-butanol/monoisobutanolamine mixture, and AMP-95 are qualified, however monoisobutylamine shows the best performance in terms of three testing results.

The invention claimed is:

1. A semi-synthetic metal working fluid, comprising:

a. at least one base oil;

b. at least one microbial growth control agent comprising monoisobutanolamine;

c. one or more organic acid;

d. one or more emulsifiers;

e. one or more concentrate additives; and f. water.

2. The semi-synthetic metal working fluid of claim 1, wherein the microbial growth control agent further comprises another amine.

3. The semi-synthetic metal working fluid of claim 1, wherein the base oil is selected from naphthenic oils, paraffinic oils, ester oils and mixtures thereof.

4. The semi-synthetic metal working fluid of claim 1, wherein the emulsifier is selected from C16-18 alcohols which have been ethoxylated or propoxylated, ethoxylated C12-C15 alcohols, sodium alkane sulfonate and alky ether carboxylates and mixtures thereof.

5. The semi-synthetic metal working fluid of claim 1, wherein the organic acid is selected from ethylhexoic acid, azelaic acid, tall oil fatty acid, 12-hydoxyl-(cis)-9-octadecenoic acid, 9-octadecenoic acid, sebacic acid, and mixtures thereof.

6. The semi-synthetic metal working fluid of claim 1, wherein the microbial growth control agent is present in an amount of from 6 to 15 percent by weight of the semi-synthetic metal working fluid.

7. The semi-synthetic metal working fluid of claim 1, wherein the base oil is present in an amount of from 10 to 45 percent by weight of the semi-synthetic metal working fluid.

8. The semi-synthetic metal working fluid of claim 1, wherein the emulsifier is present in an amount of from 5 to 20 percent by weight of the semi-synthetic metal working fluid.

9. The semi-synthetic metal working fluid of claim 1, wherein the organic acid is present in an amount of from 3 to 10 percent by weight of the semi-synthetic metal working fluid.

10. The semi-synthetic metal working fluid of claim 1, wherein the water is present in an amount of from 20 to 60 percent by weight of the semi-synthetic metal working fluid.

11. The semi-synthetic metal working fluid of claim 2 wherein the additional amine comprises 2-amino-1-butanol.

12. The semi-synthetic metal working fluid of claim 1 wherein the concentrate additive is selected from the group consisting of diethylene glycol butyl ether, ethylene glycol monobutyl ether, and propylene glycol butyl ether.

* * * * *